US008795102B2

(12) United States Patent
Knight et al.

(10) Patent No.: US 8,795,102 B2
(45) Date of Patent: Aug. 5, 2014

(54) IRON-TYPE GOLF CLUBS AND GOLF CLUB HEADS WITH A WIDE SOLE

(75) Inventors: William C. Knight, Granbury, TX (US); David N. Franklin, Granbury, TX (US)

(73) Assignee: Nike, Inc., Beaverton, OR (US)

( * ) Notice: Subject to any disclaimer, the term of this patent is extended or adjusted under 35 U.S.C. 154(b) by 507 days.

(21) Appl. No.: 13/047,625

(22) Filed: Mar. 14, 2011

(65) Prior Publication Data

US 2012/0238376 A1 Sep. 20, 2012

(51) Int. Cl.
*A63B 53/04* (2006.01)

(52) U.S. Cl.
USPC ..... 473/350

(58) Field of Classification Search
USPC ..... 473/324–350
See application file for complete search history.

(56) References Cited

U.S. PATENT DOCUMENTS 1,128,288 A * 2/1915 Churchill ..... 473/328
1,695,598 A * 12/1928 MacClain ..... 473/328
1,835,718 A * 12/1931 Morton ..... 473/328
1,945,844 A * 2/1934 Young ..... 473/328
1,975,822 A * 10/1934 Young ..... 473/328
3,079,157 A * 2/1963 Turner ..... 473/328
3,138,386 A * 6/1964 Onions ..... 473/328
3,810,631 A * 5/1974 Braly ..... 473/328
4,836,550 A * 6/1989 Kobayashi ..... 473/350
5,282,625 A * 2/1994 Schmidt et al. ..... 473/350
5,603,668 A * 2/1997 Antonious ..... 473/328
5,643,106 A * 7/1997 Baird ..... 473/328
5,683,310 A * 11/1997 Chen ..... 473/349
5,722,900 A * 3/1998 Sung ..... 473/291
5,749,795 A * 5/1998 Schmidt et al. ..... 473/350
5,800,281 A * 9/1998 Gilbert ..... 473/287
5,833,551 A * 11/1998 Vincent et al. ..... 473/350
6,086,485 A * 7/2000 Hamada et al. ..... 473/329
6,106,410 A * 8/2000 Glod et al. ..... 473/290
6,344,001 B1 * 2/2002 Hamada et al. ..... 473/329
D454,932 S * 3/2002 Mahaffey et al. ..... D21/747
6,368,232 B1 * 4/2002 Hamada et al. ..... 473/329
6,458,045 B1 * 10/2002 Chen ..... 473/342
6,709,345 B2 * 3/2004 Iwata et al. ..... 473/291

(Continued)

FOREIGN PATENT DOCUMENTS

JP 07299164 A * 11/1995 ..... A63B 53/04
JP 08257173 A * 10/1996 ..... A63B 53/00

(Continued)

OTHER PUBLICATIONS

International Search Report in corresponding International PCT Application No. PCT/US2012/026911; dated Jun. 11, 2012.

*Primary Examiner* — Alvin Hunter
(74) *Attorney, Agent, or Firm* — Banner & Witcoff, Ltd.

(57) ABSTRACT

Golf club heads according to at least some example aspects of this disclosure include: an iron-type golf club head including an iron-type golf club head body, a ball striking face, or face plate, a rear plate, a sole, and a sole channel. According to aspects of the disclosure, the sole may be considered a wide sole as compared to conventional iron-type club head. The sole may be approximately 30-50% wider than conventional iron-type club heads. Further, according to aspects of the disclosure, the sole channel may be a channel generally defined as an undercut portion removed from the sole. The sole channel may be located generally within the sole portion of the club head.

16 Claims, 11 Drawing Sheets

(56) References Cited

U.S. PATENT DOCUMENTS

| | | | | |
|---|---|---|---|---|
| 6,811,496 | B2 * | 11/2004 | Wahl et al. | 473/334 |
| 7,022,028 | B2 * | 4/2006 | Nagai et al. | 473/291 |
| 7,594,864 | B2 * | 9/2009 | Sukman | 473/334 |
| 7,867,105 | B2 * | 1/2011 | Moon | 473/314 |
| 8,021,246 | B2 * | 9/2011 | Llewellyn et al. | 473/332 |
| 8,277,337 | B2 * | 10/2012 | Shimazaki | 473/350 |
| 8,419,568 | B2 * | 4/2013 | Roberts et al. | 473/329 |
| 8,460,122 | B2 * | 6/2013 | Sukman | 473/329 |
| 2003/0134687 | A1 * | 7/2003 | Truesdale | 473/330 |
| 2003/0199331 | A1 * | 10/2003 | Stites, III | 473/290 |
| 2004/0147335 | A1 | 7/2004 | Iwata et al. | |
| 2005/0239572 | A1 | 10/2005 | Roach | |
| 2006/0030425 | A1 | 2/2006 | Sukman | |
| 2008/0051220 | A1 | 2/2008 | Soracco et al. | |

FOREIGN PATENT DOCUMENTS

| | | | | | |
|---|---|---|---|---|---|
| JP | 10314349 | A | * | 12/1998 | A63B 53/04 |
| JP | 2000229137 | A | * | 8/2000 | A63B 53/04 |
| JP | 2001058016 | A | * | 3/2001 | A63B 53/04 |
| JP | 2002248183 | A | * | 9/2002 | A63B 53/04 |
| JP | 2005168831 | A | * | 6/2005 | A63B 53/04 |
| JP | 2005253562 | A | * | 9/2005 | A63B 53/04 |

* cited by examiner

IRON-TYPE GOLF CLUBS AND GOLF CLUB HEADS WITH A WIDE SOLE

FIELD OF THE DISCLOSURE

The present disclosure relates to golf clubs and golf club heads. Particular example aspects of this disclosure relate to iron-type golf clubs and iron-type golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. In certain examples, different golf club head geometries have been developed to provide certain ball striking benefits to the golfer. Such geometries, however, can also affect other characteristics of the golf club head such as center of gravity, moment of inertia, etc. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology as prior art designs continue to have certain limitations. The present invention seeks to overcome certain of these limitations and other drawbacks of the prior art, and to provide new features not heretofore available.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head including an iron-type golf club head body, a ball striking face, or face plate, a rear plate, a sole, and a sole channel. According to aspects of the disclosure, the sole may be considered a wide sole as compared to conventional iron-type club head. The sole may be approximately 30-50% wider than conventional iron-type club heads. Further, according to aspects of the disclosure, the sole channel may be a channel generally defined as an undercut portion removed from the sole. The sole channel may be located generally within the sole portion of the club head.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc. Additional aspects of this disclosure relate to ball striking devices as described above for a golf club head or golf club structure.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
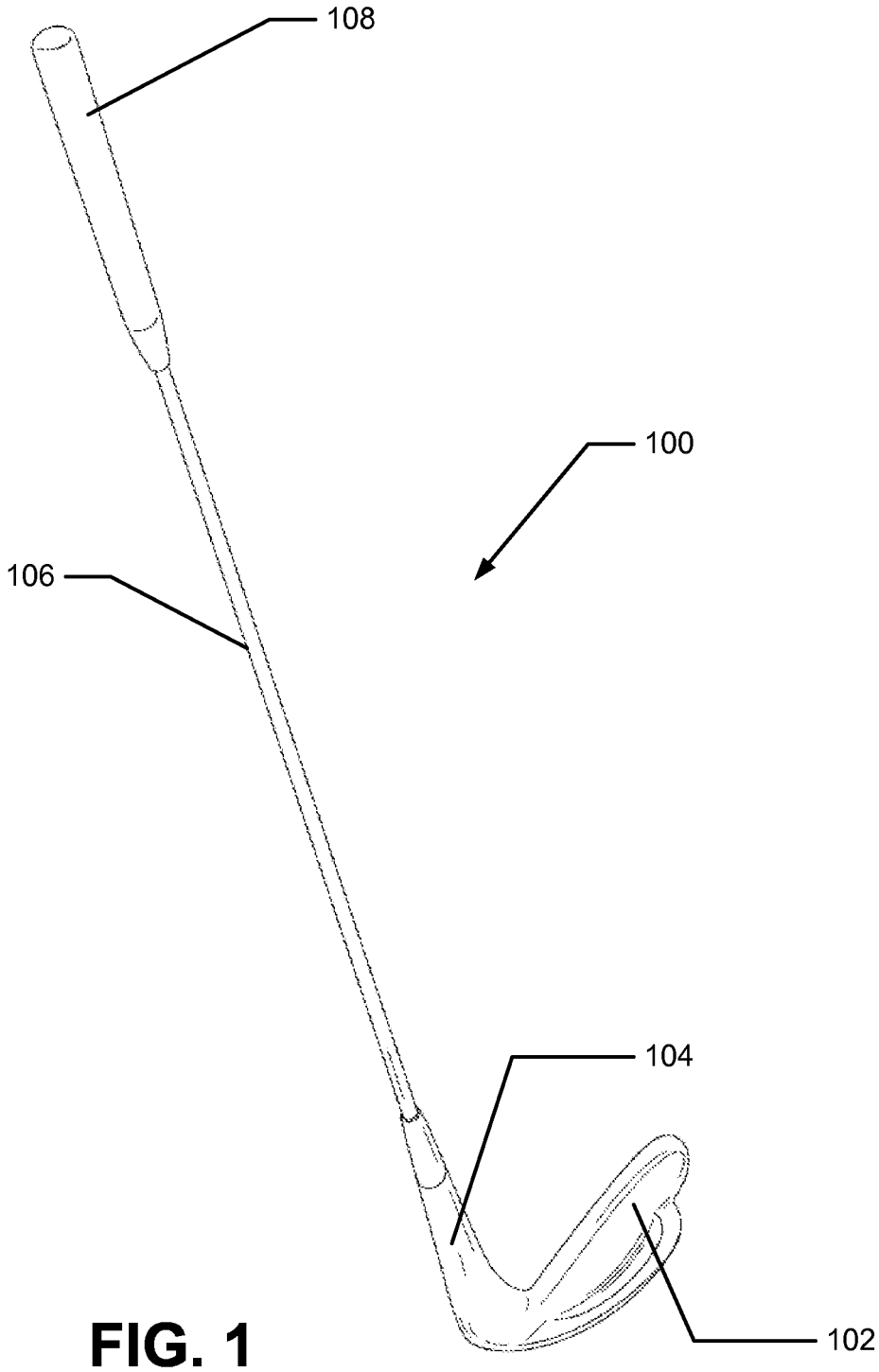
FIG. 1 is a perspective view of an illustrative embodiment of a golf club structure having a golf club head according to aspects of the disclosure.

The reader is advised that the various parts shown in these drawings are not necessarily drawn to scale.

DETAILED DESCRIPTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientation at the address position. Nothing in this specification should be construed as requiring a specific three dimensional orientation of structures in order to fall within the scope of this invention.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face, or face plate; and (c) a wide sole that includes a sole channel that is defined as an undercut portion removed from the sole.

Additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described below (including any or all of the various structures, features, and/or arrangements described below), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

Examples and features of iron-type golf club heads and golf club structures according to this disclosure will be described in detail below in conjunction with the example golf club structures illustrated in FIGS. 2-8. In more specific aspects of the invention, the examples and features of the iron-type golf club heads and golf club structures may be representative of wedge-type golf clubs and golf club heads, i.e., pitching wedge, lob wedge, gap wedge, sand wedge. Wedge-type clubs may also be listed or identified by loft angle in degrees, i.e., 48-degree wedge, 50-degree wedge, 53-degree wedge, 59-degree wedge, 62-degree wedge as some examples. Without departing from this invention, any degree wedge (or named wedge) may be utilized using the below described invention.

FIG. 1 generally illustrates an example of an iron-type golf club 100 according to aspects of the disclosure. As seen in FIG. 1, the iron-type golf club head 100 may include a golf club head 102 in accordance with the present disclosure. In addition to the golf club head 102, the overall golf club structure 100 of this example includes a hosel 104, a shaft member 106 received in and/or inserted into and/or through the hosel 104, and a grip or handle member 108 attached to the shaft member 106 or be considered a part of the shaft member 106. Optionally, if desired, the hosel 104 may be eliminated and the shaft member 106 may be directly inserted into and/or otherwise attached to the golf club head 102 (e.g., through an opening provided in the top of the club head 102, through an internal hosel member (e.g., provided within an interior chamber defined by the club head 102), etc.). The hosel 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron-type club head structure may be used without departing from this disclosure.

The shaft member 106 may be received in, engaged with, and/or attached to the club head 102 in any suitable or desired manner, including in conventional manners known and used in the art, without departing from the disclosure. As more specific examples, the shaft member 106 may be engaged with the club head body 102 via the hosel 104 and/or directly to the club head structure 102, e.g., via adhesives, cements, welding, soldering, mechanical connectors (such as threads, retaining elements, or the like), etc.; through a shaft-receiving sleeve or element extending into the club head 102; etc. If desired, the shaft 106 may be connected to the golf club head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

Figure 2:
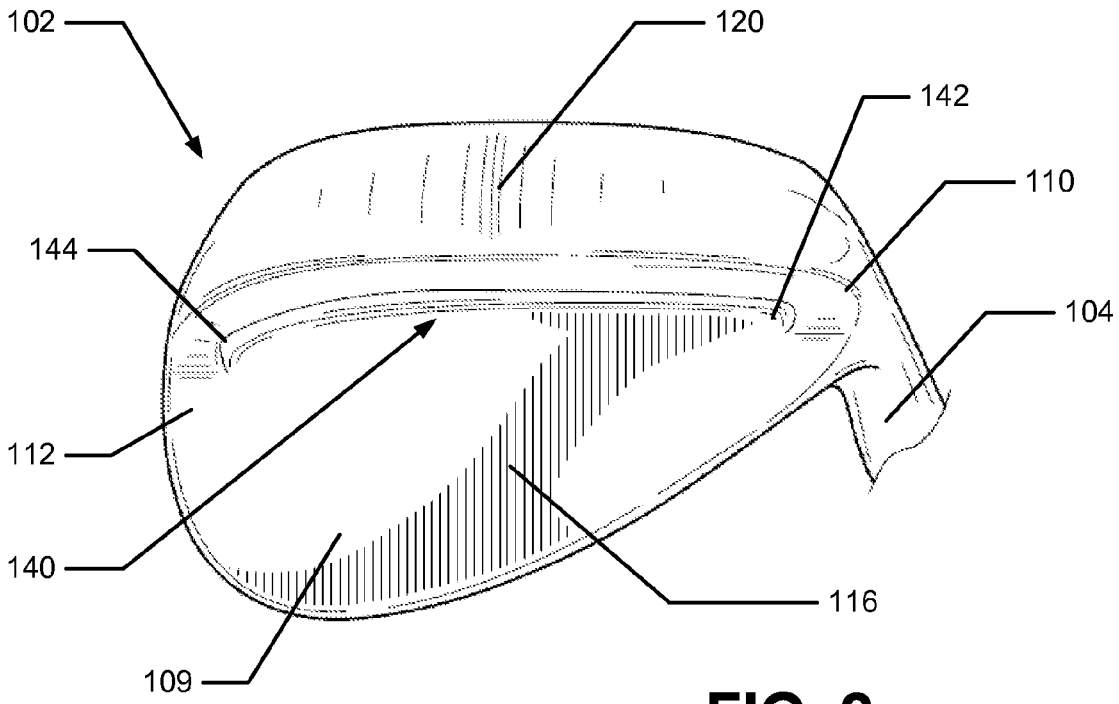
FIG. 2 is a rear view of the golf club head illustrated in FIG. 1 according to aspects of the disclosure.
Figure 3:
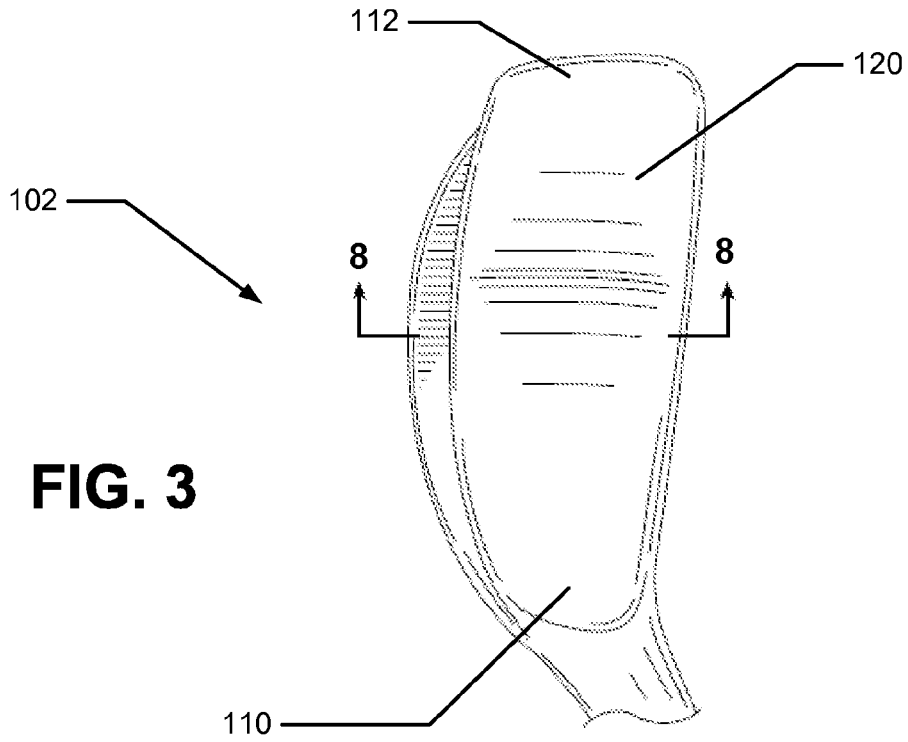
FIG. 3 is a bottom view of the golf club head illustrated in FIG. 1 according to aspects of the disclosure.
Figure 4:
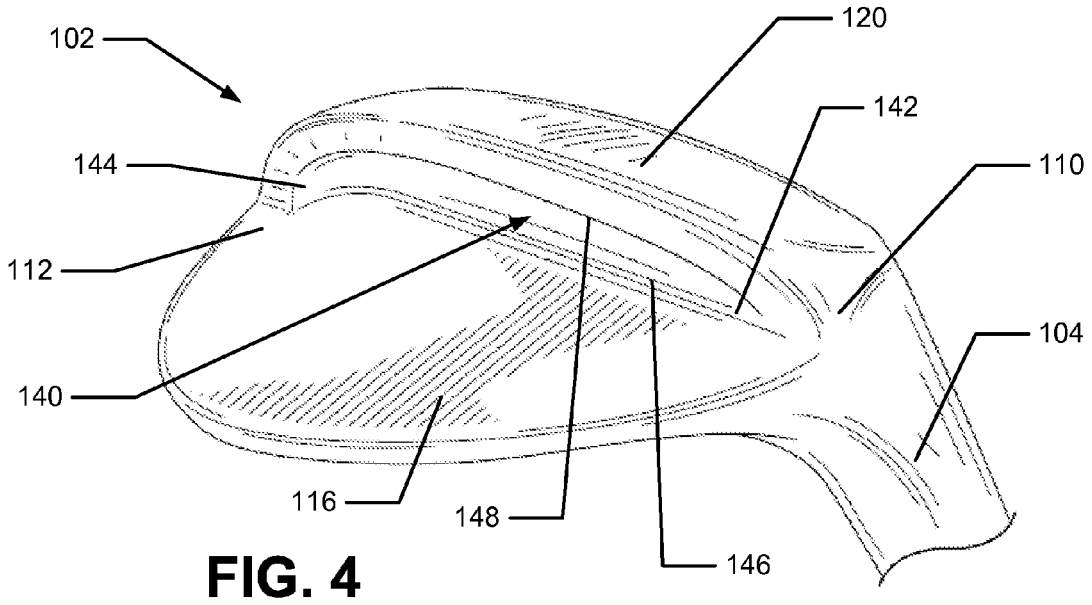
FIG. 4 is a perspective view of the golf club head illustrated in FIG. 1 according to aspects of the disclosure.
Figure 5:
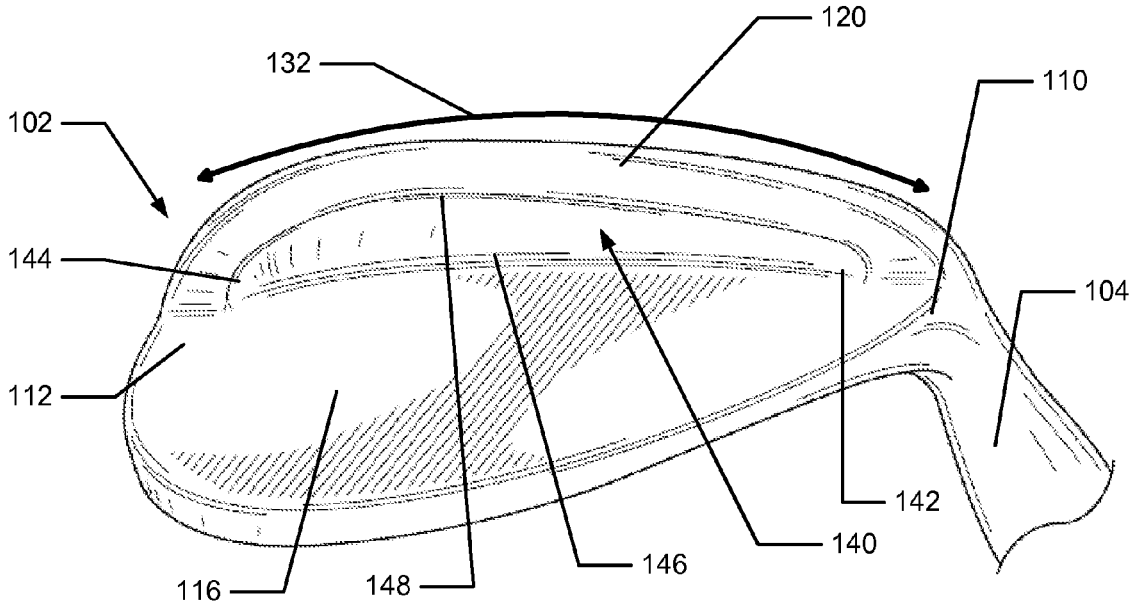
FIG. 5 is another perspective view of the golf club head illustrated in FIG. 1 according to aspects of the disclosure.
Figure 6:
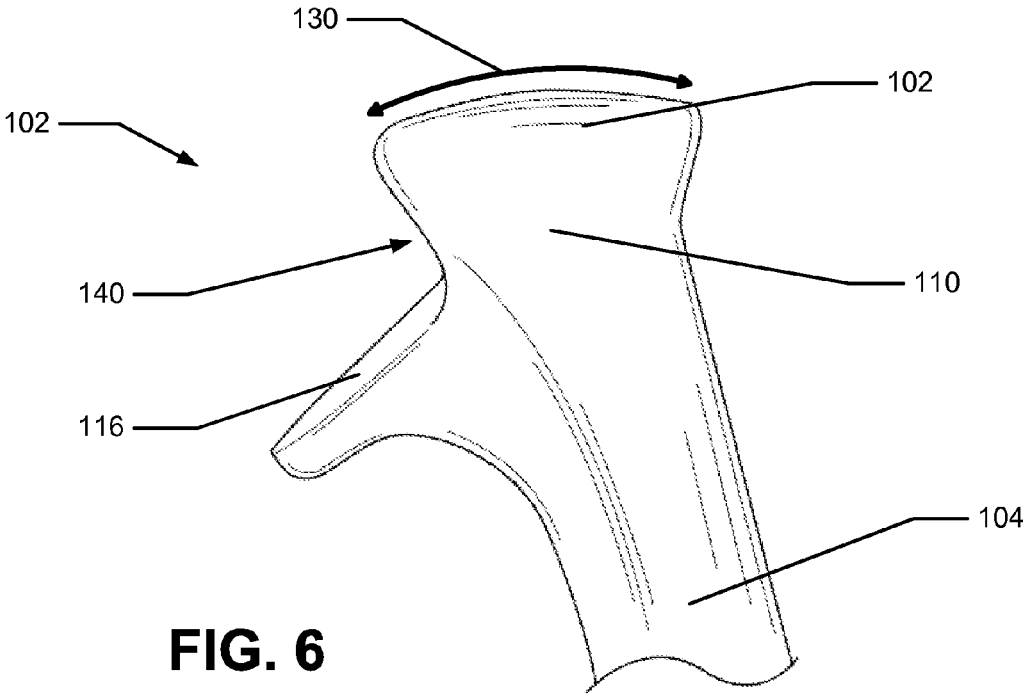
FIG. 6 is a side view of the golf club head illustrated in FIG. 1 according to aspects of the disclosure.
Figure 7:
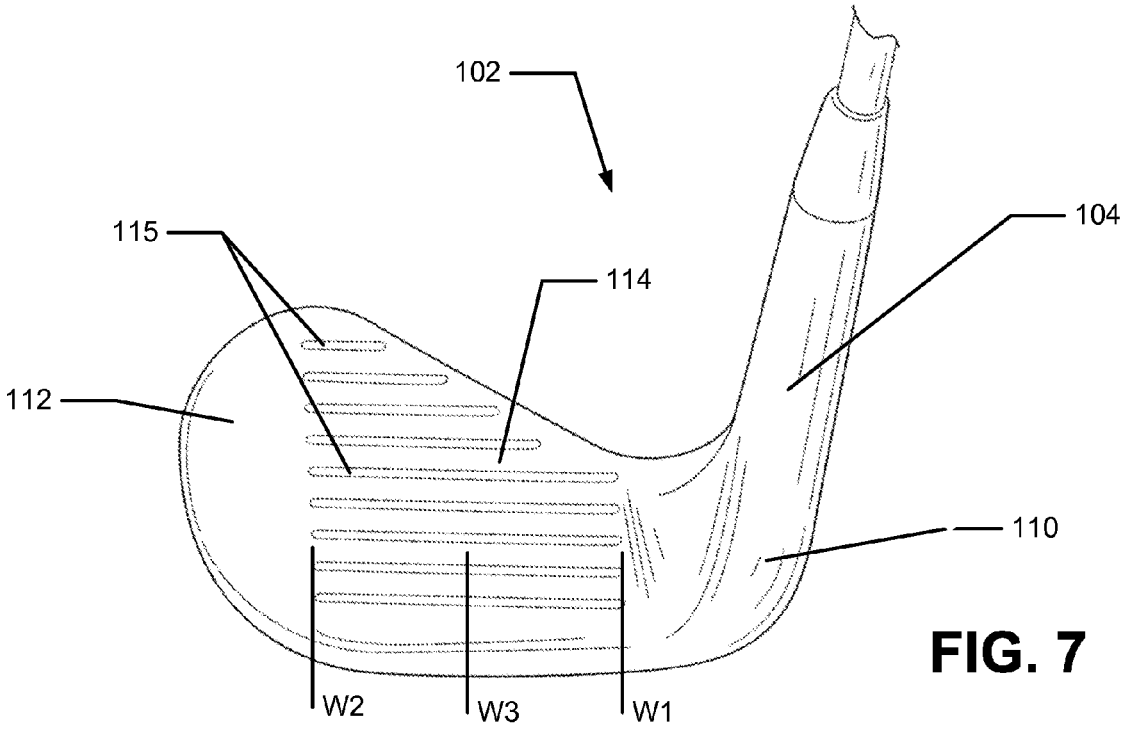
FIG. 7 is another perspective view of the golf club head illustrated in FIG. 1 according to aspects of the disclosure.
Figure 8:
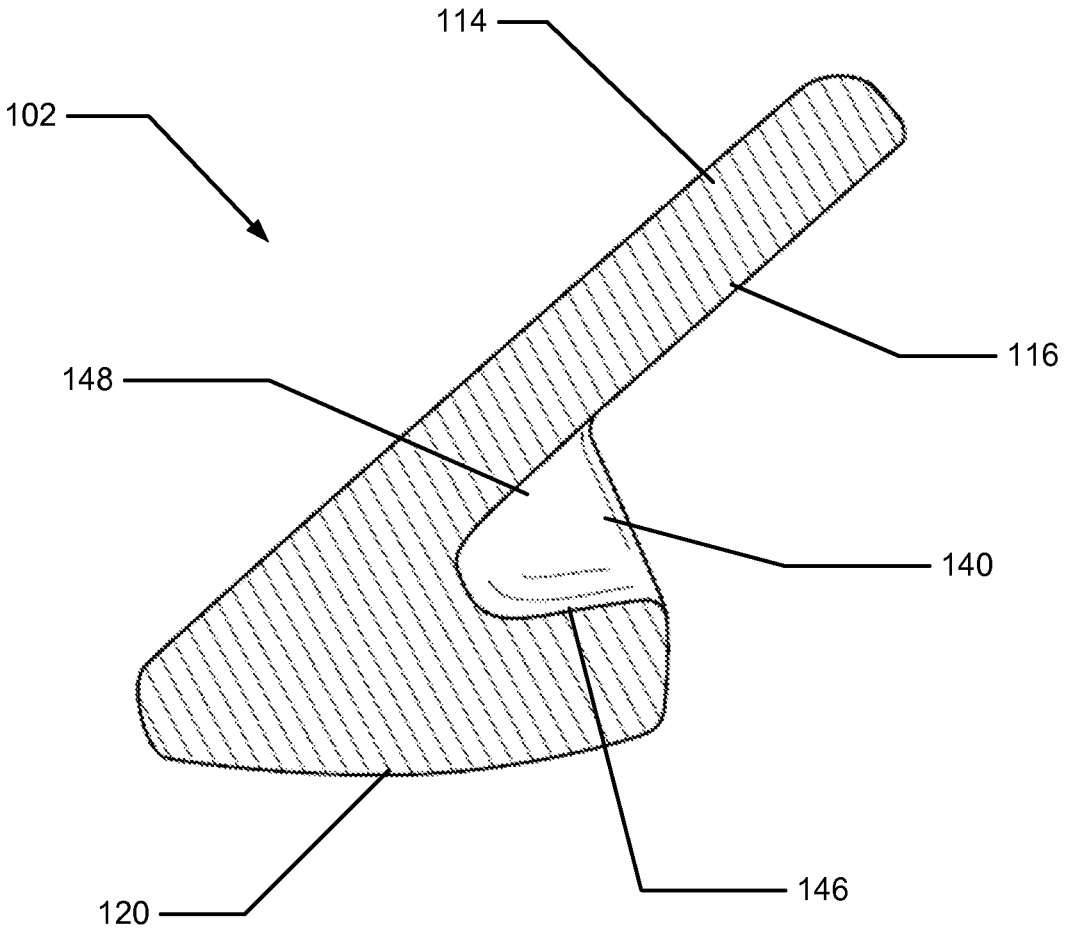
FIG. 8 is a cross-sectional view of the golf club head illustrated in FIG. 1 taken along Line 8-8 in FIG. 3 according to aspects of the disclosure.

Aspects of the disclosure relate to particular structures of the golf club head 102. FIGS. 2-8 illustrate various views of a golf club head 102 according to one embodiment of this disclosure. As seen in FIGS. 2-8, the golf club head 102 may include a golf club head body 109, a heel 110, a toe 112, a ball striking face plate 114, and a rear plate 116. Specifically, FIG. 2 is a rear view of an illustrative embodiment of the golf club head 102 according to aspects of the disclosure. FIG. 3 is a bottom view of the embodiment of the golf club head 102 according to aspects of the disclosure. FIG. 4 is a rear side-angled view of the embodiment of the golf club head 102 according to aspects of the disclosure. FIG. 5 is a rear top-angled view of the embodiment of the golf club head 102 according to aspects of the disclosure. FIG. 6 is a side view of the embodiment of the golf club head 102 according to aspects of the disclosure. FIG. 7 is a top-angled view of the embodiment of the golf club head 102 according to aspects of the disclosure. FIG. 8 is a cross-sectional view of the embodiment of the golf club head 102 taken along Line 8-8 shown in FIG. 3.

According to aspects of the disclosure, as illustrated in FIGS. 2-8, the heel 110 may be located generally adjacent to the hosel 104. The toe 112 may be located generally opposite the heel 110 and the hosel 104. Additionally, the ball striking face plate 114 (FIG. 7) may be located generally at the front of the golf club head 102 and the ball striking face plate 114 may be used to strike a golf ball. The ball striking face plate 114 may extend generally from the heel 110 to the toe 112. The rear plate 116 may be located generally at the rear of the golf club head 102 opposite the ball striking face plate 114. The rear plate 116 may extend generally from the heel 110 to the toe 112. In accordance with aspects of this invention, the rear plate 116 may have an uninterrupted or planar shape wherein there is no cut-out or cavity located in the rear plate 116. This uninterrupted or planar shape may extend throughout the entire rear plate 116 without departing from this invention. The rear plate 116 may be considered an integral part of the golf club head body 109.

Additionally, the club head 102 may include a sole or a sole portion 120. The sole 120 is located generally at the bottom of the club head 102. The sole 120 may extend generally from the heel 110 to the toe 112. Generally, the sole 120 of this invention may be considered a wide sole as compared to conventional iron-type club heads as will be detailed below. This wide sole 120 may help create lift more efficiently to the golf club head 102 as it contacts and moves through the ground during golf ball contact thereby giving a user more room for swing-error when contacting the ground. Additionally, the wide sole 120 may give the user more confidence with their golf swing and during the golf ball contact due to the wide nature of the sole.

Traditionally, wider soles will generally move the weight and center of gravity of the golf club head 102 too low in the golf club head 102, which will thereby decrease performance of the golf club head 102. Generally, it is better to have the center of gravity located higher on the club head giving a user more area of the ball striking face 114 to successfully contact the golf ball. In order to accommodate the wide sole of the present invention, the golf club head 102 may include a sole channel 140. The sole channel 140 may be a channel generally defined as an undercut portion removed from the sole 120. The sole channel 140 may be located generally in the rear of the golf club head 102 and generally within the sole portion 120 of the golf club head 102. The sole channel 140 may extend generally from the heel area 110 to the toe area 112. Additionally, in other embodiments without departing from this invention, the sole channel 140 may extend generally from a location that does not extend to either the heel area 110 or the toe area 112. The sole channel 140 may remove weight from the sole 120 which thereby allows the center of gravity of the club head 102 to be raised up the club head ball striking face 114 by having more mass higher in the club head ball striking face 114.

Therefore, each of the above described features of a golf club head 102 according to aspects of the disclosure, alone, and in combination, may create lift on the club head 102 when the golf club head 102 contacts the ground during golf ball impact. As a result, the sole channel 140 removes weight created by the wide sole 120, thereby allowing for a higher center of gravity on the ball striking face 114 by having more mass higher on the ball striking face 114. Consequently, the user is capable of using a wide sole iron-type golf club 100 that allows good contact with the ground while maintaining a high center of gravity location and sweet spot for golf ball contact on the ball striking face 114.

A variety of club head 102 constructions are possible without departing from this disclosure. For example, if desired, some or all of the various individual parts of the club head 102 described above may be made from multiple pieces that are connected together (e.g., by adhesives or cements; by welding, soldering, brazing, or other fusing techniques; by mechanical connectors; etc.). Additionally, the club head 102 may also be a unitary piece that, if desired, includes some or all of the various individual parts of the club head 102 described above. The various parts (e.g., the heel 110, toe 112, ball striking face plate 114, rear plate 116, and sole 120, etc.) may be made from any desired materials and combinations of different materials, including materials that are conventionally known and used in the art, such as metal materials, including lightweight metal materials, composite materials, polymer materials, steel, titanium, aluminum, tungsten, magnesium, beryllium, alloys including one or more of these metals, carbon-fiber reinforced materials, glass-fiber reinforced materials, graphite, etc.

Additionally, the club head 102 may be constructed in any suitable or desired manner without departing from this disclosure, including in conventional manners known and used in the art. The club head 102 and its various parts may be made by forging, casting, molding, stamping, pressing, machining, grinding, and/or using other techniques and processes, including techniques and processes that are conventional and known in the art.

Having provided the reader with a general understanding of various features of golf club heads according to aspects of the disclosure, elements which comprise the golf club head 102, and specifically the sole 120 and the sole channel 140, will be described in detail below with specific reference to FIGS. 9 through 11B.

Figure 9:
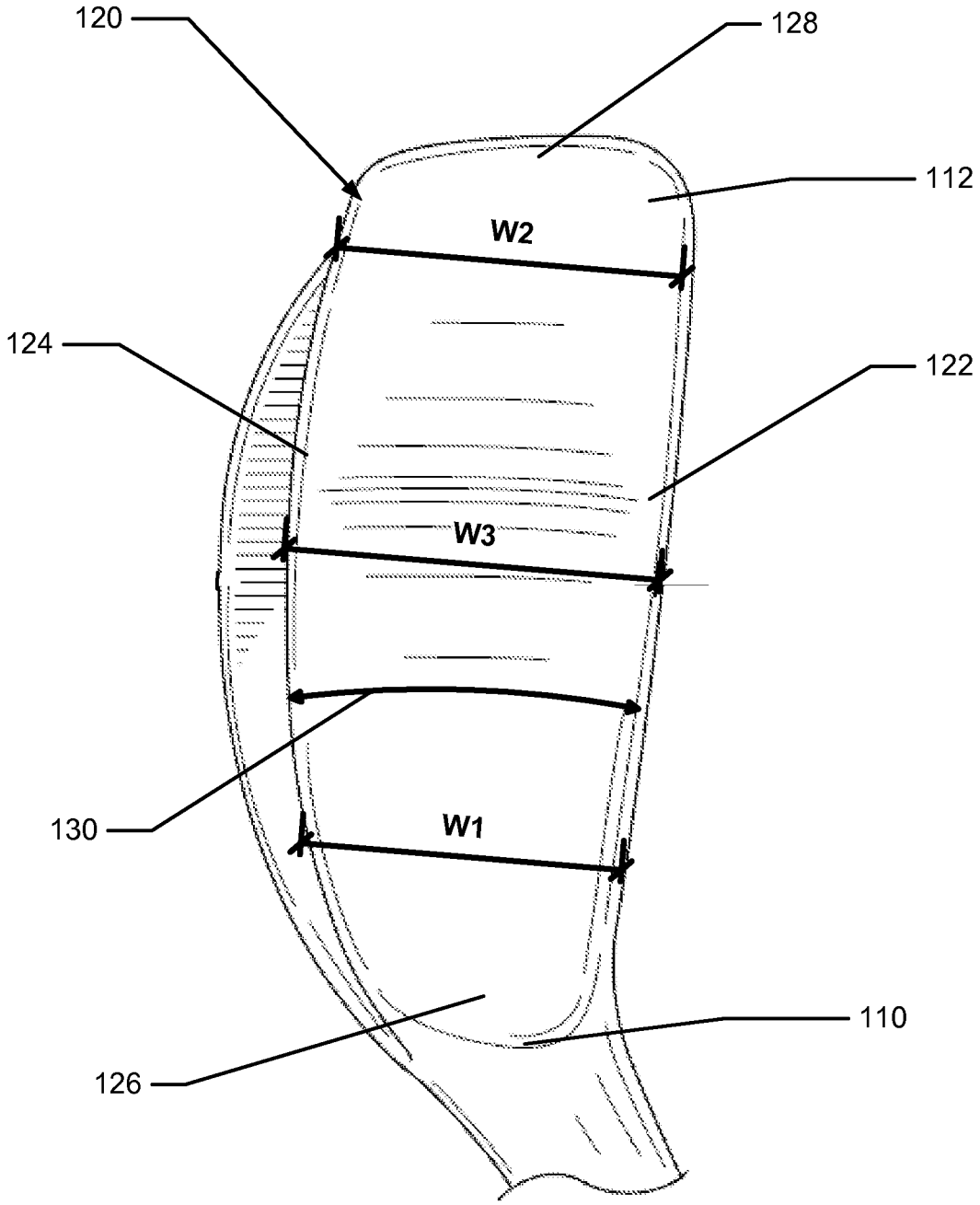
FIG. 9 is another bottom view of the golf club head illustrated in FIG. 1 according to aspects of the disclosure.

According to aspects of the disclosure, as illustrated in FIG. 9, the sole 120 may be defined by a sole front edge 122 and a sole back edge 124. The sole front edge 122 may be located generally adjacent to the intersection of a bottom edge of the ball striking face plate 114 and the sole 120, or an interface point of the ball striking face plate 114 and the sole 120. The sole front edge 122 may extend generally from the heel 110 to the toe 112. The sole back edge 124 may be located generally opposite the sole front edge 122 on the sole 120. The sole back edge 124 may extend generally from the heel 110 to the toe 112. The sole front edge 122 and the sole back edge 124 are generally on opposite sides of the sole 120.

Additionally, the sole 120 may be further defined by a sole heel edge 126 and a sole toe edge 128. The sole heel edge 126 may be located generally near the heel side of the golf club head 102. The sole heel edge 126 may extend generally from the sole front edge 122 to the sole back edge 124. Similarly, the sole toe edge 128 may be located generally near the toe side of the golf club head 102. The sole toe edge 128 may extend generally from the sole front edge 122 to the sole back edge 124.

As was described above, the sole 120 of the present invention may be considered a wide sole in comparison to the soles of conventional iron-type golf clubs and wedge-type golf club heads. For example, as shown in FIG. 9, the sole 120 may include three separate sole width measurements, W1, W2, W3. The sole width measurements W1, W2, W3 may be defined as the distance on the regions on the sole 120 from the far edge of the front edge 122 to the opposite far edge of the rear edge 124. W1 may be defined as a heel sole width measurement, measured at a location near or proximate to the sole heel edge 126. W1, as illustrated in FIG. 7, may be further defined as being measured at a location equivalent to the location of the heel end of the score lines 115 on the ball striking face 114. W2 may be defined as a toe sole width measurement, measured at a location near or proximate to the sole toe edge 128. W2, as illustrated in FIG. 7, may be further defined as being measured at a location equivalent to the location of the toe end of the score lines 115 on the ball striking face 114. W3 may be defined as a middle sole width measurement, measured at a location approximately equidistant between W1 and W2. Below is a table (Table 1) illustrating the difference between the sole width measurements W1, W2, W3 for a particular exemplary 59-degree wedge club head in accordance with this invention as compared to the sole width measurements for a conventional 59-degree wedge club head.

TABLE 1

Difference Between Sole Width Measurements W1, W2, W3 - 59-Degree Wedge

| 59-Degree Wedge | Exemplary Club Head In Accordance With This Invention | Conventional Golf Club Head |
|---|---|---|
| W1 - Heel sole width | 0.855-0.860 inches | 0.610-0.615 inches |
| W2 - Toe sole width | 1.080-1.085 inches | 0.720-0.725 inches |
| W3 - Middle sole width | 1.110-1.105 inches | 0.780-0.785 inches |

As is illustrated above in Table 1, the difference of the heel sole width W1 between the exemplary 59-degree wedge and a conventional 59-degree wedge is approximately 0.245 inches. The heel sole width W1 of the exemplary 59-degree wedge is approximately 40% larger than the heel sole width of a conventional 59-degree wedge. Similarly, the difference of the toe sole width W2 between the exemplary 59-degree wedge and a conventional 59-degree wedge is approximately 0.360 inches. The toe sole width W2 of the exemplary 59-degree wedge is approximately 50% larger than the toe sole width of a conventional 59-degree wedge. Similarly, the difference of the middle sole width W3 between the exemplary 59-degree wedge and a conventional 59-degree wedge is approximately 0.320 inches. The middle sole width W3 of the exemplary 59-degree wedge is approximately 41% larger than the middle sole width of a conventional 59-degree wedge.

As further comparison, below is a second table (Table 2) illustrating the difference between the sole width measurements W1, W2, W3 for a particular exemplary 53-degree wedge club head in accordance with this invention as compared to the sole width measurements for a conventional 53-degree wedge club head.

TABLE 2

Difference Between Sole Width Measurements W1, W2, W3 - 53-Degree Wedge

| 53-Degree Wedge | Exemplary Club Head In Accordance With This Invention | Conventional Golf Club Head |
|---|---|---|
| W1 - Heel sole width | 0.680-0.685 inches | 0.570-0.575 inches |
| W2 - Toe sole width | 0.845-0.850 inches | 0.585-0.590 inches |
| W3 - Middle sole width | 0.825-0.830 inches | 0.675-0.680 inches |

As is illustrated above, the difference of the heel sole width W1 between the exemplary 53-degree wedge and a conventional 53-degree wedge is approximately 0.110 inches. The heel sole width W1 of the exemplary 53-degree wedge is approximately 19% larger than the heel sole width of a conventional 53-degree wedge. Similarly, the difference of the toe sole width W2 between the exemplary 53-degree wedge and a conventional 53-degree wedge is approximately 0.260 inches. The toe sole width W2 of the exemplary 53-degree wedge is approximately 44% larger than the toe sole width of a conventional 53-degree wedge. Similarly, the difference of the middle sole width W3 between the exemplary 53-degree wedge and a conventional 53-degree wedge is approximately 0.150 inches. The middle sole width W3 of the exemplary 53-degree wedge is approximately 22% larger than the middle sole width of a conventional 53-degree wedge.

Tables 1 and 2 describe particular exemplary golf club heads in accordance with the present invention. Other golf club heads with different sole width measurements may be utilized in accordance with the present invention. Without departing from this invention, the sole width measurements W1, W2, W3 may be between approximately 0.5 inches and 1.5 inches. Additionally, without departing from this invention, the sole width measurements W1, W2, W3 may be between approximately 0.75 inches and 1.25 inches. Additionally, for the present invention, the club head 102 may have sole width measurements W1, W2, W3 in the range of 0.8-1.2 inches, 0.85-1.15 inches, or 0.9-1.1 inches without departing from this invention.

Figure 10A:
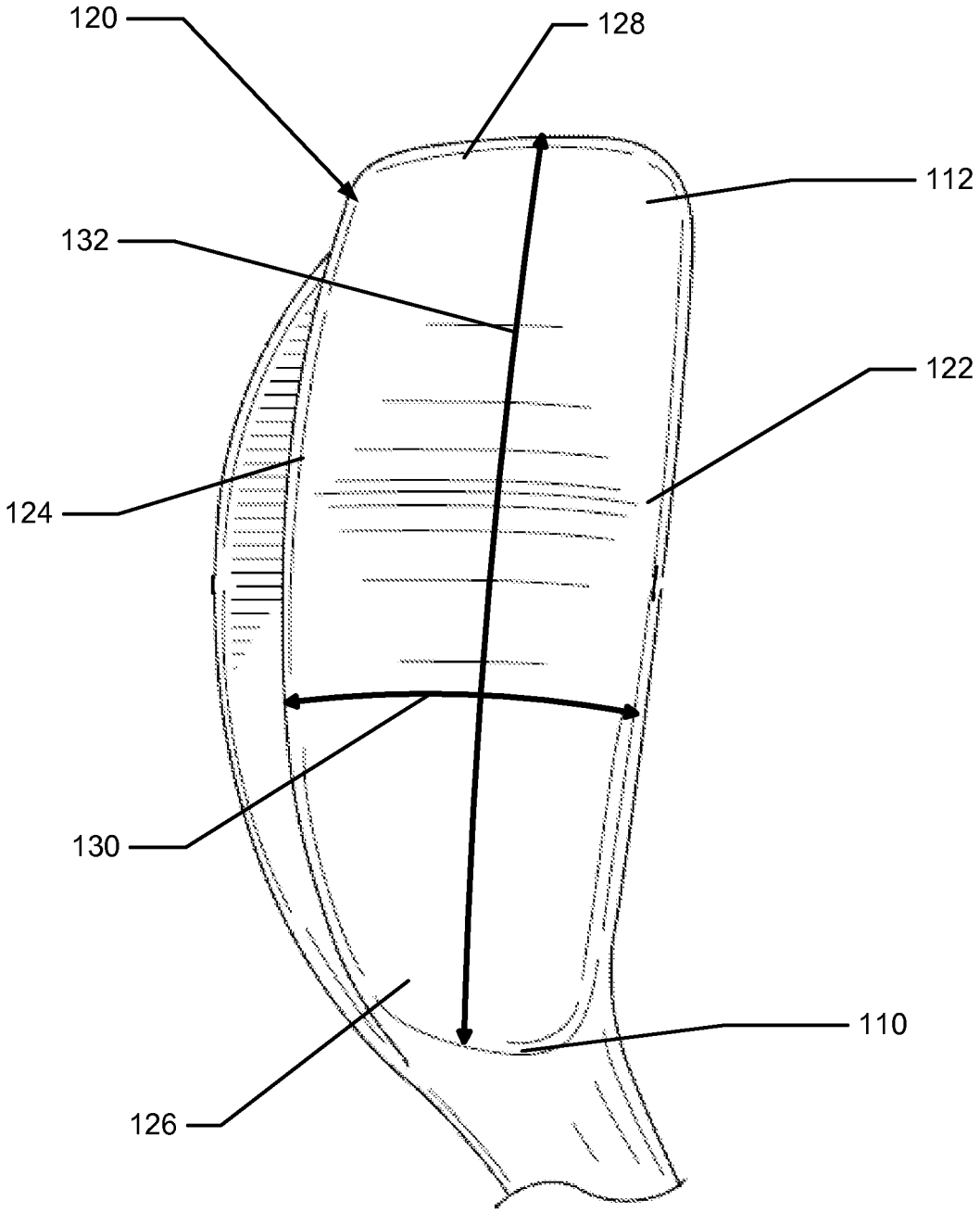
FIG. 10A is another bottom view of the golf club head illustrated in FIG. 1 according to aspects of the disclosure.

Additionally, the sole 120 may include a front-to-rear curvature radius 130. The front-to-rear curvature radius, as illustrated in FIGS. 6 and 10A, may be defined as the radius of the curvature of the sole from the front edge 122 to the rear edge 124. For example, for a particular exemplary 59-degree wedge, the front-to-rear curvature radius 130 may be approximately 2.5 inches. Additionally, for the present invention, the sole 120 may have a front-to-rear curvature radius 130 of approximately 0.5 inches, approximately 1 inch, approximately 1.5 inches, approximately 2 inches, approximately 2.5 inches, approximately 3 inches, approximately 3.5 inches, or approximately 4 or more inches without departing from this invention.

Figure 10B:
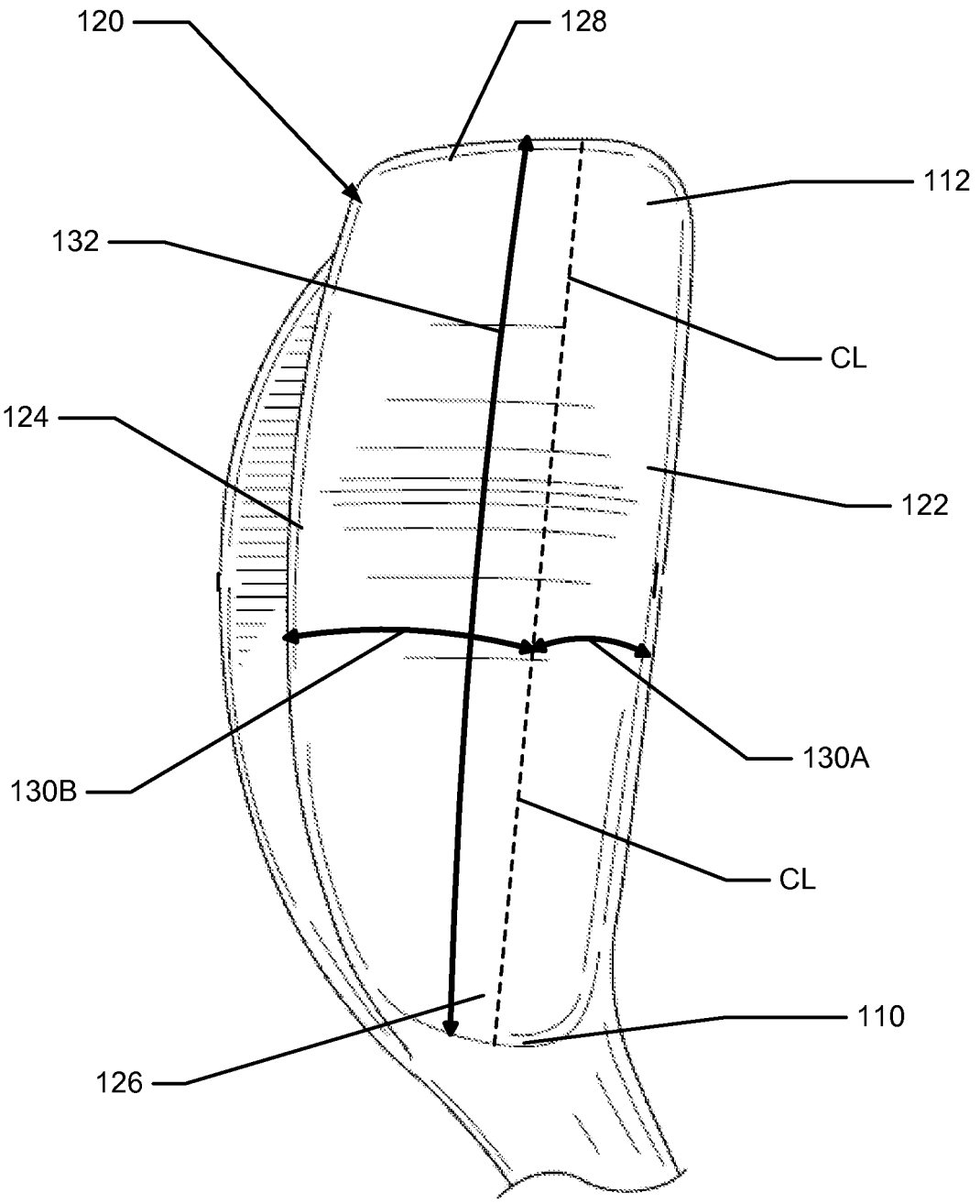
FIG. 10B is another bottom view of the golf club head illustrated in FIG. 1 according to aspects of the disclosure.

In another embodiment, without departing from the invention, the front-to-rear curvature radius 130 may include multiple radius sections, wherein each radius section may have a different front-to-rear curvature radii 130. As illustrated in FIG. 10B, the front-to-rear curvature radius 130 may include a first radius section 130A and a second radius section 130B.

The exemplary 53-degree wedge illustrated in FIG. 10B includes a first radius section 130A with an approximate 1 inch radius and a second radius section 130B with an approximate 2 inches radius. In this particular exemplary 53-degree wedge illustrated in FIG. 10B, the first radius section 130A extends from the front edge 122 to a convergence line CL approximately 0.275 inches from the front edge 122. The second radius section 130B extends from the point approximately 0.275 inches from the front edge 122 to the rear edge 124. Without departing from this invention, this convergence line CL may be located anywhere along the width of the sole 130. This invention is not limiting to different convergence line CL locations. Additionally, for the present invention, just as was described above for the exemplary 53-degree wedge, the first radius section 130A and the second radius section 130B (and any additional radius sections included to make up the front-to-rear curvature radius 130) may have a radius of approximately 0.5 inches, approximately 1 inch, approximately 1.5 inches, approximately 2 inches, approximately 2.5 inches, approximately 3 inches, approximately 3.5 inches, or approximately 4 or more inches without departing from this invention.

Additionally, the sole 120 may include a heel-to-toe curvature radius 132. The heel-to-toe curvature radius, as illustrated in FIGS. 5 and 10A, may be defined as the radius of the curvature of the sole from the heel edge 126 to the toe edge 128. For example, for a particular exemplary 59-degree wedge as illustrated in FIG. 10A and a particular exemplary 53-degree wedge as illustrated in FIG. 10B, the heel-to-toe radius 132 may be approximately 7 inches. Additionally, for the present invention, the sole 120 may have a heel-to-toe radius 132 of approximately 2 inches, approximately 3 inches, approximately 4 inches, approximately 5 inches, approximately 6 inches, approximately 7 inches, approximately 8 inches, approximately 9 inches, or approximately 10 or more inches without departing from this invention. Additionally, as was described above for the front-to-rear curvature radius 130, the heel-to-toe radius 132 may also include multiple radius sections with each having a different heel-to-toe radii.

While the golf club head 102 includes a wide sole 120, the wide sole moves the weight low on the club face, thereby moving the center of gravity lower on the ball striking face 114 and potentially decreasing club performance for certain golfers. To solve this dilemma, the golf club head 102 of the present invention may include the sole channel 140 previously recited. The sole channel 140 allows for a higher center of gravity on the ball striking face 114 because the weight has been taken from the sole area 120.

As was described above and as illustrated in FIGS. 2-8, the sole channel 140 may be a channel defined as an undercut portion removed from the sole 120. The sole channel 140 may have an elongated rounded shape wherein the cross-sectional shape of the sole channel 140 may be in the shape of a "U" or a "V". In other embodiments, the sole channel 140 may have an elongated rectangular shape or other polygonal shapes without departing from this invention. The sole channel 140 may be located generally in the rear of the golf club head 102 and generally within the sole portion 120 of the golf club head 102. The sole channel 140 may be considered to be positioned within the sole 120 and extending into the sole 120 from the rear of the golf club head body 109.

As illustrated in FIGS. 2, 4, 5, and 8, the sole channel 140 may be defined by four edges, making up the sole channel. The sole channel 140 may be defined by a channel heel edge 142 located proximate to the heel 110. Additionally, the sole channel 140 may be defined by a channel toe edge 144 located proximate to the toe 112. The channel toe edge 144 may be located opposite or distal to the channel heel edge 142. The sole channel 140 also may be defined by a channel sole edge 146. The channel sole edge 146 may be generally parallel to a ground plane of the sole 120. Additionally, the sole edge 146 extends straight rearward from the sole channel, thereby removing additional weight from the sole 120. Because the channel sole edge 146 is generally parallel to the ground plane of the sole 120, more weight is taken from the sole 120 of the club head 102, thereby allowing the center of gravity of the club head 102 to move further up the ball striking face plate 114. Additionally, the sole channel 140 may be defined by a channel rear edge 148. The channel rear edge 148 may be located opposite or distal to the channel sole edge 146.

Figure 11A:
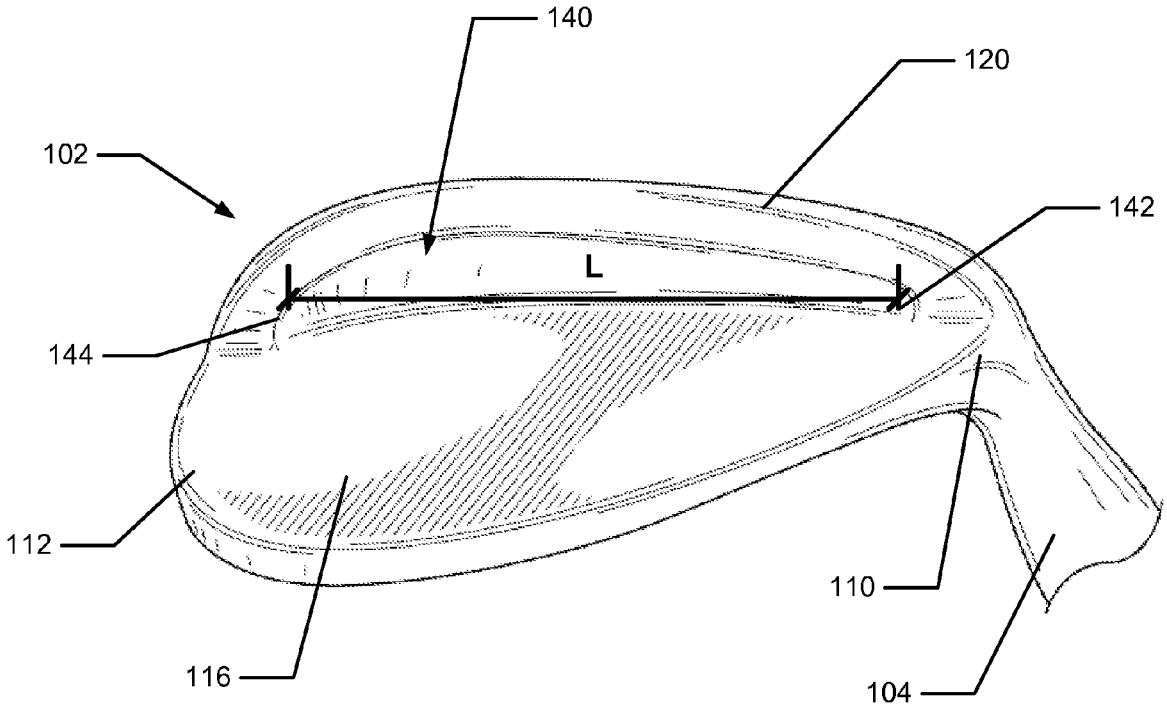
FIG. 11A is another perspective view of the golf club head illustrated in FIG. 1 according to aspects of the disclosure.
Figure 11B:
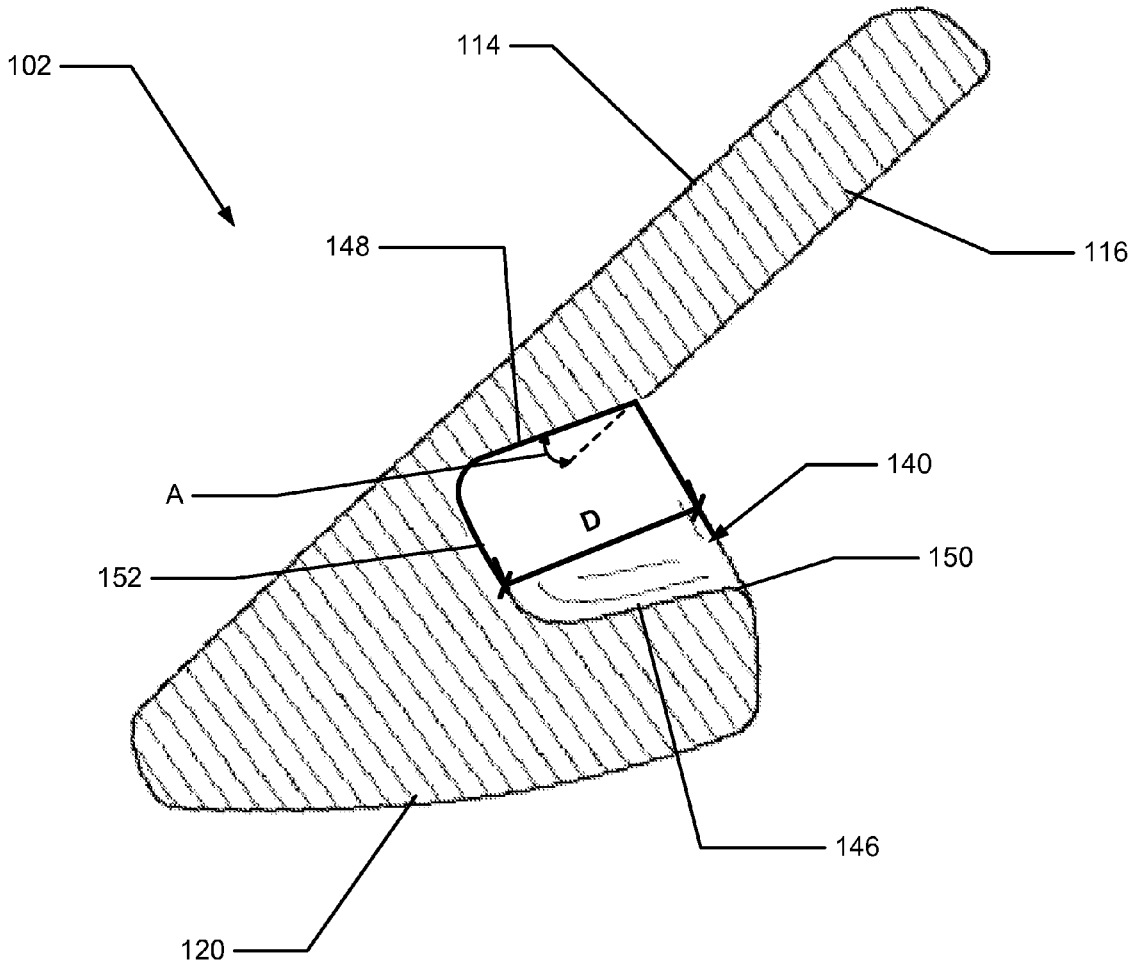
FIG. 11B is a cross-sectional view of another embodiment of a golf club head according to aspects of the disclosure.
Figure 12:
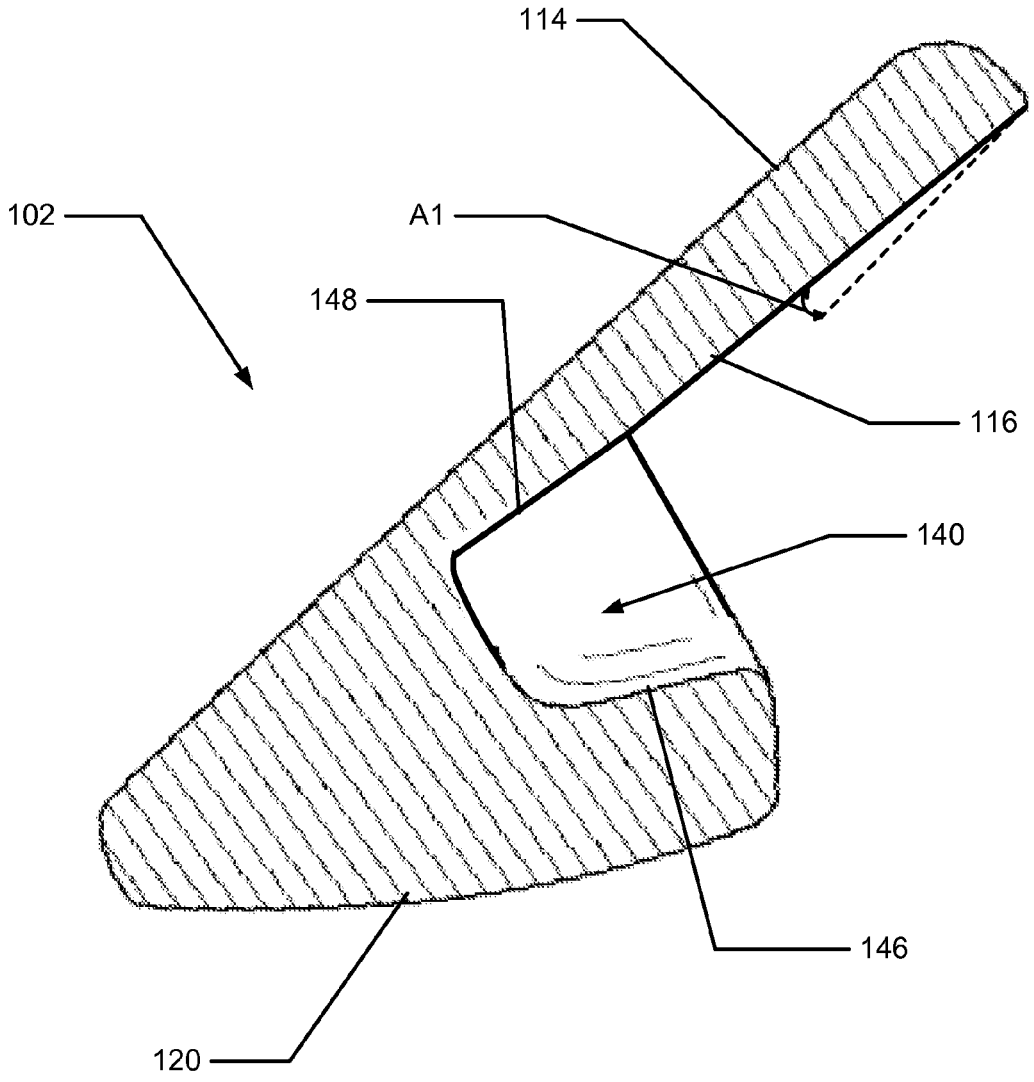
FIG. 12 is a cross-sectional view of another embodiment of a golf club head according to aspects of the disclosure.

In one embodiment in accordance with the present invention, the sole channel 140 may extend towards the ball striking face plate 114 and not parallel to the face plate 114 (as illustrated in FIGS. 11B and 12 and described below). The sole channel 140 may also extend generally from the heel area 110 to the toe area 112. Additionally, in other embodiments without departing from this invention, the sole channel 140 may extend generally from a location that does not reach either the heel area 110 or the toe area 112. The sole channel 140 generally removes weight from the sole 120 which thereby allows the center of gravity of the club head 102 to be raised up the club head ball striking face 114 by having more mass higher in the club head ball striking face 114.

A conventional ideal total weight of a golf club head 102 may be approximately 300 grams. In a particular exemplary wedge club head 102, the sole channel 140 may remove approximately eight to eleven grams of weight from the sole 120 and club head 102, or approximately 3-4% of the total weight of the golf club head 102. Such weight may be redistributed to other locations on the club head 102 to selectively control the center of gravity on the ball striking face plate 114. Additionally, for the present invention, the sole channel 140 may remove weight of approximately 6 grams, approximately 7 grams, approximately 8 grams, approximately 9 grams, approximately 10 grams, approximately 11 grams, approximately 12 grams, or approximately 13 grams or more without departing from this invention.

In another embodiment without departing from this invention, according to aspects of this disclosure, as illustrated in FIGS. 11A and 11B, the sole channel 140 may be further defined by a length L, a depth D, and a channel angle A. Without departing from the invention, the length L and depth D may be various combinations while maintaining the above target weight removal from the sole 120 and club head 102.

As illustrated in FIG. 11A, the length L may be defined as the distance from the heel edge 142 of the sole channel 140 (for example nearest to the heel 110) to the toe edge 144 of the sole channel 140 (for example nearest to the toe 112). In a particular exemplary club head 102, the length L of the sole channel 140 may be approximately 2.5 inches. Additionally, for the present invention, the sole channel 140 may have a length L of approximately 0.5 inches, approximately 1 inch, approximately 1.5 inches, approximately 2 inches, approximately 2.5 inches, or approximately 3 inches or more without departing from this invention.

Additionally, as illustrated in FIG. 11B, the sole channel 140 may include a depth D. The depth D of the sole channel 140 may be defined as the distance from a front edge 150 of the sole channel 140 to a bottom 152 of the sole channel 140. In a particular exemplary club head 102, the depth D of the sole channel 140 may be approximately 0.2 inches. Additionally, for the present invention, the sole channel 140 may have a depth D of approximately 0.05 inches, approximately 0.1 inches, approximately 0.15 inches, approximately 0.2 inches, approximately 0.25 inches, or approximately 0.3 inches or more without departing from this invention.

Additionally, as illustrated in FIG. 11B, the sole channel 140 may include a channel angle A. The channel angle A of the sole channel 140 may be defined as an angle taken from a reference line parallel or on the same plane as the ball striking face 114. In a particular exemplary club head 102, the channel angle A of the sole channel 140 may be approximately 20 degrees. Additionally, for the present invention, the sole channel 140 may have a channel angle A of approximately 5 degrees, approximately 10 degrees, approximately 15 degrees, approximately 20 degrees, approximately 25 degrees, or approximately 30 degrees or more without departing from this invention.

Additionally, the sole channel 140 may include a volume. In a particular exemplary club head 102, the volume of the sole channel 140 may be approximately 700 to 800 cubic millimeters. Additionally, for the present invention, the sole channel 140 may have a volume of approximately 400 cubic millimeters, approximately 500 cubic millimeters, approximately 600 cubic millimeters, approximately 700 cubic millimeters, or approximately 800 cubic millimeters or more without departing from this invention.

FIG. 12 illustrates an alternate embodiment of the present invention. As illustrated in FIG. 12, the rear plate 116 may be non-parallel to the ball striking face plate 114. Instead, the rear plate 116 is angled in towards the ball striking face plate 114, causing a variable thickness for the ball striking face plate 114. The sole channel 140 is similar to as described above. This embodiment removes weight from the sole 120 which thereby allows the center of gravity of the club head 102 to be raised up the club head ball striking face 114 by having more mass higher in the club head ball striking face 114.

The sole channel 140 may be fabricated in various different methods. One exemplary method may be used to form the sole channel 140 from the sole using a mill. Various shaped and sized mills may be used to form the sole channel 140 without departing from the invention. In one particular exemplary method, the sole channel 140 may be fabricated using a mill that may be tilted approximately 20 degrees for the sole channel 140 using a 0.187 ballnose end mill along a 0.25 inch layout line from the sole 140. Other dimensions and methods for cutting or fabricating the sole channel 140 may be utilized for the club head 102 without departing from this invention.

A wide variety of overall club head constructions are possible without departing from this disclosure. For example, it is noted that the dimensions and/or other characteristics of a golf club head 102 according to examples of this disclosure may vary significantly without departing from the disclosure. For example, while the above described configuration may be particularly useful in wedges (e.g., pitching wedges, lob wedges, gap wedges, sand wedges, etc.), the features described above may be incorporated into any iron-type club head including, for example: iron-type hybrid clubs, driving irons, 0 through 10 irons, etc.

Additional aspects of this disclosure relate to methods for producing and or manufacturing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, or by obtaining it from a third party source, etc.; (b) engaging a shaft member with the golf club head body; and (c) engaging a grip member with the shaft member.

Additionally, step (a) above, providing a golf club head body, may further include the steps of (1) casting a club head body 109 including any or all of the various structures, features, and/or arrangements described above and (2) milling the sole channel 140 in the sole 120 and club head body 109. As was described above, the milling of the sole channel 140 may be milled using various shaped and sized mill end pieces to form the sole channel 140 without departing from the present invention. In one particular exemplary method, the sole channel 140 may be milled using a mill using a 0.187 ballnose end mill. Further, with the ball striking face 114 flat on the block or table, the mill may be tilted approximately 20 degrees to mill the sole channel 140. Additionally, for the present invention, the mill may be tilted approximately 5 degrees, approximately 10 degrees, approximately 15 degrees, approximately 20 degrees, approximately 25 degrees, or approximately 30 degrees or more without departing from this invention. Other dimensions and methods for cutting or fabricating the sole channel 140 may be utilized for the club head 102 without departing from this invention.

Without departing from the present invention, step (a) above, providing a golf club head body, may further include the steps of casting a unitary club head body 109 including any or all of the various structures, features, and/or arrangements described above, and including the sole channel 140 within the sole 120. Additionally, without departing from the present invention, step (a) above, providing a golf club head body, may further include the steps of (1) forging a club head body 109 including any or all of the various structures, features, and/or arrangements described above and (2) milling the sole channel 140 in the sole 120 and club head body 109. Additionally, without departing from the present invention, step (a) above, providing a golf club head body, may further include the steps of forging a unitary club head body 109 including any or all of the various structures, features, and/or arrangements described above, and including the sole channel 140 within the sole 120. Without departing from the invention, the club head 102 and its various parts may be made by forging, casting, molding, stamping, pressing, machining, grinding, and/or using other techniques and processes, including techniques and processes that are conventional and known in the art.

The iron-type golf club and golf club head according to this invention provides many benefits over the current golf clubs and golf club heads. First, the sole 120 of the present invention may be considered a wide sole as compared to conventional iron-type club heads. The wide sole 120 may help create lift more efficiently to the golf club head 102 as it contacts and moves through the ground during golf ball contact thereby giving a user more room for swing-error when contacting the ground. Additionally, the wide sole 120 may give the user more confidence with their golf swing and during the golf ball contact due to the wide nature of the sole.

Secondly, as wider soles on golf club heads generally move the club head weight and center of gravity of the golf club head 102 too low in the golf club head 102, performance of the golf club head 102 can be decreased. Generally, it is better to have the center of gravity located higher on the club head 102 giving a user more area of the ball striking face 114 to successfully contact the golf ball. In order to accommodate the wide sole of the present invention, the golf club head 102 may include a sole channel 140. The sole channel 140 may remove weight from the sole 120 which thereby allows the center of gravity of the club head 102 to be raised up the club head ball striking face 114 by having more mass higher in the club head ball striking face 114.

Therefore, each of the above described features of a golf club head 102 according to aspects of the disclosure, alone, and in combination, may create lift on the club head 102 when the golf club head 102 contacts the ground during golf ball impact. As a result, the sole channel 140 removes weight created by the wide sole 120, thereby allowing for a higher center of gravity on the ball striking face 114 by having more mass higher on the ball striking face 114. Consequently, the user is capable of using a wide sole iron-type golf club 100 that allows good contact with the ground while maintaining a high center of gravity location and sweet spot for golf ball contact on the ball striking face 114.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 11B may be used individually and/or in any combination or subcombination without departing from this disclosure.

We claim:

1. An iron-type golf club head comprising:

a ball striking face plate configured for striking a ball;

a rear plate opposite the ball striking face plate;

a body adjacent to the ball striking face plate, the body including a heel adjacent to a hosel and a toe opposite the heel, the body further having a sole extending rearward from a bottom edge of the ball striking face plate from the heel to the toe, wherein the sole includes a sole width defined as the distance from a sole front edge adjacent to the ball striking face plate and a sole back edge opposite the sole front edge, wherein the sole width has a minimum width of approximately 0.8 inches and a maximum width of approximately 1.2 inches; and an elongated sole channel positioned within the sole, the channel being undercut into the sole and extending along at least a portion of the sole and extending towards the ball striking face, the sole channel having a length defined by the distance from a first end of the sole channel proximate to the heel to a second end of the sole channel proximate to the toe, wherein the length is between approximately two and three inches, and further the sole channel having a depth, the sole channel having a depth defined by the distance from a front edge of the sole channel to a bottom of the sole channel, wherein the depth is between approximately 0.1 inches and 0.2 inches.

2. The iron-type golf club head of claim 1, wherein the sole channel extends proximate from the heel to the toe.

3. The iron-type golf club head of claim 1, wherein the sole channel removes weight from the sole thereby moving a center of gravity of the club head up the ball striking face plate.

4. The iron-type golf club head of claim 3, wherein the weight removed from the sole is between approximately seven to nine grams of weight.

5. The iron-type golf club head of claim 3, wherein the weight removed from the sole is between approximately ten to eleven grams of weight.

6. The iron-type golf club head of claim 1, wherein length is approximately 2.5 inches.

7. The iron-type golf club head of claim 1, wherein the depth is approximately 0.20 inches.

8. The iron-type golf club head of claim 1, the sole channel having a channel angle defined by an angle taken from a reference line on a plane equivalent to the ball striking face plate, wherein the channel angle is between approximately five degrees and twenty-five degrees.

9. The iron-type golf club head of claim 8, wherein the channel angle is approximately 10 degrees.

10. The iron-type golf club head of claim 1, wherein the sole is defined by a sole front edge adjacent to the ball striking face plate and a sole back edge opposite the sole front edge.

11. The iron-type golf club head of claim 10, wherein the sole is further defined by a sole heel edge proximate to the heel and a sole toe edge proximate to the toe.

12. The iron-type golf club head of claim 1, wherein the sole width has a minimum width of approximately 0.6 inches and a maximum width of approximately 0.9 inches.

13. The iron-type golf club head of claim 1, wherein the sole channel has a "U"-shaped cross-sectional shape.

14. The iron-type golf club head of claim 1, wherein the sole channel has a rectangular-shaped cross-sectional shape.

15. An iron-type golf club head comprising:

a ball striking face plate configured for striking a ball;

a rear plate opposite the ball striking face plate;

a body adjacent to the ball striking face plate, the body including a heel adjacent to a hosel and a toe opposite the heel, the body further having a sole extending rearward from a bottom edge of the ball striking face plate from the heel to the toe, wherein the sole includes a sole width defined as the distance from a sole front edge adjacent to the ball striking face plate and a sole back edge opposite the sole front edge, wherein the sole width has a minimum width of approximately 0.8 inches and a maximum width of approximately 1.2 inches; and an elongated sole channel positioned within the sole, the channel being undercut into the sole and extending along at least a portion of the sole and extending towards the ball striking face and not parallel to the ball striking face, the sole channel having:

a length defined by the distance from a first end of the sole channel proximate to the heel to a second end of the sole channel proximate to the toe, wherein the length is between approximately two inches and three inches, a depth defined by the distance from a front edge of the sole channel to a bottom of the sole channel, wherein the depth is between approximately 0.1 inches and 0.2 inches, and a channel angle defined by an angle taken from a reference line on a plane equivalent to the ball striking face plate, wherein the channel angle is between approximately ten degrees and twenty degrees.

16. The iron-type golf club head of claim 15, wherein the sole width has a minimum width of approximately 0.6 inches and a maximum width of approximately 0.9 inches.

* * * * *